US006595813B1

(12) United States Patent
Lekhtman

(10) Patent No.: US 6,595,813 B1
(45) Date of Patent: Jul. 22, 2003

(54) FEET-PROPELLED WATER VEHICLE

(76) Inventor: Gregory Lekhtman, 1550, rue Dr Penfield, P.H. 3, Montreal, QBC (CA), H3G 1C2

( * ) Notice: Subject to any disclaimer, the term of this patent is extended or adjusted under 35 U.S.C. 154(b) by 0 days.

(21) Appl. No.: 10/107,189

(22) Filed: Mar. 28, 2002

(51) Int. Cl.[7] ..... B63H 16/00; B63B 35/83
(52) U.S. Cl. ..... 440/21; 441/76
(58) Field of Search ..... 440/13, 14, 15, 440/21, 22; 441/76

(56) References Cited

U.S. PATENT DOCUMENTS 3,640,240 A * 2/1972 Stein ..... 440/22
3,722,015 A * 3/1973 Miller et al. ..... 440/22
3,809,003 A * 5/1974 Foldvari ..... 440/29
4,193,371 A * 3/1980 Baulard-Caugan ..... 440/15
4,214,547 A * 7/1980 Hetland ..... 440/22
4,246,861 A * 1/1981 Mikina et al. ..... 440/23
4,345,903 A 8/1982 Laser
4,642,056 A 2/1987 Keivanjah
4,936,802 A 6/1990 Ueno
4,968,273 A * 11/1990 Momot ..... 440/22
5,163,857 A 11/1992 Hinsley
5,385,497 A * 1/1995 Chu ..... 440/21
5,462,466 A * 10/1995 Hull et al. ..... 440/22
5,593,334 A 1/1997 Thayer
5,607,331 A * 3/1997 Lekhtman ..... 440/23
5,702,274 A * 12/1997 White ..... 440/21

* cited by examiner

*Primary Examiner*—S. Joseph Morano
*Assistant Examiner*—Andrew Wright

(57) ABSTRACT

A feet-propelled water vehicle including a buoyant body having a user-supporting platform attached to a rigid frame secured to a pair of pontoons. A pair of propelling paddles is attached to the rigid frame. Each propelling paddle defines a corresponding effectuating section and a corresponding blade section. The supporting platform defines flexible foot contacting regions for transferring the weight shifting action of an intended user to the effectuating sections of a corresponding propelling paddle. Each effectuating section allows the transformation of the force generated by the foot of the user into a corresponding pivotal movement of the paddle relative to the frame. The blade section attached to the effectuating section allows transformation of the pivotal movement of the paddle into a vehicle propelling force for propelling the vehicle across a body of water.

20 Claims, 5 Drawing Sheets

FEET-PROPELLED WATER VEHICLE

FIELD OF THE INVENTION

The present invention relates to the general field of water recreational vehicles and is particularly concerned with a foot operated water vehicle.

BACKGROUND OF THE INVENTION

With the advent of the so-called leisure society and a concurrent trend towards health beneficial recreational exercises, many individuals are looking for new and exciting recreational outdoor activities.

Water related recreational activities are particularly popular. Human powered water-born vehicles have been around for many years. They seem to have shown a relatively slow evolutional pattern. The evolution of the technology of human-powered water-born vehicles seems to have been determined, at least in part, by the most economic use of materials. The rowing stroke required to propel or steer a floating device such as a typical rowboat was to develop pivot points on which a pair of oars could rest. Once this was accomplished, the operator would face the rear of the boat, lift the oars out of the water, then deposit the flat surfaces of the oars into the water. The arms and braced legs would exert force to pull the oar blades back, while the pressure against the oar surfaces would create forward movement of the boat.

This could only be accomplished if the rowing oars where maintained in position by oar locks. Conventional rowing was limited to energy exerted mostly by upper body through arm movement and also sometimes by lower body movement through the braced leverage of the legs.

Another method of achieving similar forward motion of a floating vessel is often referred to as the paddling technique. In the paddling technique, the paddler faces forward and no pivot point is required to obtain the results. The energy developed by the user of a conventional canoe paddle comes almost exclusively from upper body strength and is not effective in other vessel designs.

Another technique of propelling a small craft using human power is the so-called pedal- or paddle-boat. The pedal-boat typically utilizes a bicycle crank which engages a paddle-wheel or propeller thorough a series of mechanical linkages. The conventional paddle-boats are typically propelled by continuously rotating the paddle wheels. Commonly, such crafts are pontoon-based with seats that allow the user to sit high above the water. In general, they are noted for ponderous movement and relatively limited speed capabilities.

More recent developments included fiberglass boats of various types with transmission devices allowing reciprocating motion to be transformed into rotational motion by some conventional means. By improving the hydrodynamic contour of the craft, greater speed may be achieved but, to date, the limitations on speed have been such that boats that are paddled or rowed are ordinarily faster and more efficient than conventional paddle-type crafts.

In an attempt to improve on the speed deficiencies associated with conventional paddle-type foot-propelled water crafts and also to provide a more challenging and exciting type of foot-propelled water craft, numerous variations of apparatuses used for walking on water have heretofor been developed.

Typically, most conventional foot-propelled water devices used for walking on water include structures and/or floats which support a person on water in a standing position. The float structures are propelled through the water by leg movements of the operator. With such prior art devices, the floats structures are typically interconnected to allow relative movement therebetween. The float structures area typically provided with components for increasing the resistance to movement of the float in one direction of operator leg movement and decreasing the resistance to movement of the float in the opposite direction of operator leg movement in order to aid in the overall movement of the float structures.

Although prior art devices have taken many forms, they have generally proven unsatisfactory due to either complexity, difficulty of manufacture, size, cost, and other factors. Various drawbacks exist with prior art devices of this nature which are believed to have kept these devices from becoming commercially acceptable. One such problem is control, for example, as a user propels himself or herself through the water with a walking movement, there is a natural tendency for the individual floats or shoes to drift apart. Also, heretofor, the prior art floats were made large enough to support to heaviest user and thus resulted in bulky devices which were hard to transport over land.

Although the disadvantages associated with prior art leg or foot-propelled water craft allowing for propulsion in a standing position include overly complex structures, lack of reliability, lack of stability, lack of propulsion efficiency, lack of ergonomic features and so forth. Also, prior art devices are typically relatively bulky requiring large storage and transportation space. Accordingly, there exists a need for an improved feet-propelled water vehicle.

SUMMARY OF THE INVENTION

Advantages of the present invention include that the proposed feet-propelled water vehicle allows for propulsion of the vehicle by an intended user while the latter is in a standing position. Propulsion of the vehicle is effectuated by the legs of the intended user as the latter performs a simple and ergonomic weight shifting movement, or a step-like movement. The proposed vehicle allows for an efficient transformation of the user force into a propelling force for propelling the vehicle across the body of water.

Also, the proposed vehicle is specifically designed so as to provide for various size and angular adjustments in order to provide an ergonomic vehicle associated with increased pleasure during use and decreased risks of activity related injuries.

Furthermore, the proposed vehicle allows an intended user to quickly master the skills required for its operation without lengthy or difficult training. The proposed vehicle hence allows both individuals to quickly benefit from its use while providing sports enthusiasts with the possibility of customizing the vehicle so that the latter remains challenging.

Still furthermore, the proposed vehicle is specifically designed so as to be easily assembled and disassembled through a set of quick and easy steps, without requiring special tooling or manual dexterity so as to provide a vehicle which may be easily disassembled for storage or transportation and assembled at a site of usage. Also, the proposed vehicle is designed so as to be manufacturable using conventional forms of manufacturing through a set of conventional manufacturing steps so as to provide a vehicle which will be economically feasible, long-lasting and relatively trouble-free in operation.

Overall, the proposed vehicle is intended to provide an improved new and fun feet-propelled water vehicle that can be used both for leisure and transportation.

According to the present invention, there is provided a feet-propelled water vehicle for allowing an intended user having a pair of feet to travel across the surface of a body of water, each of the feet being able to transmit a user force emanating from the user, the vehicle comprises:

a buoyant body, the body defining a body first end and a generally opposed body second end;

a propelling paddle operatively coupled to the buoyant body for movement relative thereto;

the propelling paddle defining an effectuating section and a blade section, the effectuating section allowing the transformation of the user force into a paddle movement of the paddle relative to the buoyant body, the blade section allowing the transformation of the paddle movement into a vehicle propelling force for propelling the vehicle when the blade section is in contact with the body of water.

Preferably, the vehicle includes a first propelling paddle and a second propelling paddle, the first and second propelling paddles being both operatively coupled to the buoyant body for movement relative thereto;

the first and second propelling paddles each defining a corresponding effectuating section and a corresponding blade section, each of the effectuating sections allowing the transformation of the user force into a corresponding paddle movement relative to the buoyant body, each of the blade sections allowing the transformation of a corresponding paddle movement into a vehicle propelling force for propelling the vehicle across the body of water.

Preferably, each of the first and second propelling paddles is operatively coupled to the buoyant body so as to be able to move in a first paddle direction generally towards the buoyant body and in a second paddle direction generally away from the buoyant body, the vehicle further comprising an alternating means for ensuring that the first and second propelling paddles move alternatively relative to each other in opposite paddle directions.

Preferably, the alternating means further ensures that at least a portion of the user force exerted on one of the first or second propelling paddles for moving the latter in a given paddle direction is transmitted to the other propelling paddle for moving the latter in the other paddle direction.

Preferably, the first and second propelling paddles are operatively coupled to the buoyant body for pivotal movement relative thereto, each of the first and second propelling paddles being operatively coupled to the buoyant body so as to be able to pivot in a first paddle direction generally towards the buoyant body and in a second paddle direction generally away from the buoyant body;

the vehicle further comprising an alternating means for ensuring that the first and second propelling paddles pivot alternatively relative to each other in opposite paddle directions, the alternating means further ensuring that at least a portion of the user force exerted on one of the first or second propelling paddles for pivoting the latter in a given paddle direction is transmitted to the other propelling paddle for pivoting the latter in the other paddle direction.

Preferably, the alternating means includes an alternating pulley rotatably attached to the buoyant body for rotation about a pulley axis, the alternating means also including a generally elongated and flexible alternating transmission component, the alternating transmission component defining a pair of longitudinally opposed transmission component ends, each of the transmission component ends being attached to one of the propelling paddle; the transmission component being at least partially wound around the alternating pulley for guided movement relative thereto; whereby the alternating pulley rotatably guides the movement of the transmission component as the later ensures that the first and second propelling paddles pivot alternatively relative to each other in opposite paddle directions.

Preferably, the buoyant body includes a user-supporting platform, the user-supporting platform defining a generally flexible force transmitting section, the force transmitting section being able to deform under the action of the user force so as to transmit the user force to the propelling paddle.

Preferably, the buoyant body includes a generally rigid peripheral frame and a generally flexible user-supporting platform attached to the peripheral frame, the user-supporting platform being able to deform under the action of the user force so as to transmit the user force to the propelling paddle.

Preferably, the user-supporting platform defines a foot contacting region for contacting at least one of the feet and wherein the vehicle further comprises a force transmitting component positioned intermediate the propelling paddle and the user-supporting platform, the force transmitting component including a spacing section attached to the propelling paddle and a foot contacting section attached to the spacing section, the foot contacting section being configured, sized and positioned so as to be able to contact the user-supporting platform adjacent the foot contacting region, the force transmitting component maintaining at least a section of the user-supporting platform and the propelling paddle in a spaced relationship relative to each other while allowing the transmission of the user force from the user-supporting platform to the propelling paddle.

Preferably, the force transmitting component is an elongated plate, the elongated plate having a substantially semi-elliptical shape defining two opposed longitudinal ends thereof and a central apex region therebetween, the two longitudinal ends forming the spacing section and the apex region forming the foot contacting section, the force transmitting component being provided with a semi-elliptical shape adjusting means for allowing adjustment of the semi-elliptical shape of the elongated plate so as to adjust the spaced relationship between the propelling paddle and the user-supporting platform.

Preferably, the peripheral frame includes tubular members assembled together, and the user-supporting platform includes a sheet of flexible material attached to the tubular members for protecting the user from being watered by splashing water, the vehicle further comprising at least one pontoon attached to the peripheral frame.

Preferably, the pontoon is an inflatable pontoon.

Preferably, the vehicle further comprises a steering structure attached to the buoyant body, the steering structure including a rudder and a steering handle attached to the rudder.

Preferably, the blade section is releasably attached to the effectuating section.

Preferably, the vehicle is collapsible, the tubular members being releasably attached to each other, the propelling paddles being releasably attached to the buoyant body, the at least one pontoon being releasably attached to the peripheral frame and the steering structure being releasably attached to the buoyant body.

Other objects and advantages of the present invention will become apparent from a careful reading of the detailed description provided herein, within appropriate reference to the accompanying drawings.

BRIEF DESCRIPTION OF THE DRAWINGS

An embodiment of the present invention will now be disclosed, by way of example, in reference to the following drawings in which like reference characters indicate like elements throughout.

DETAILED DESCRIPTION OF THE PREFERRED EMBODIMENTS

With reference to the annexed drawings the preferred embodiments of the present invention will be herein described for indicative purpose and by no means as of limitation.

Figure 1:
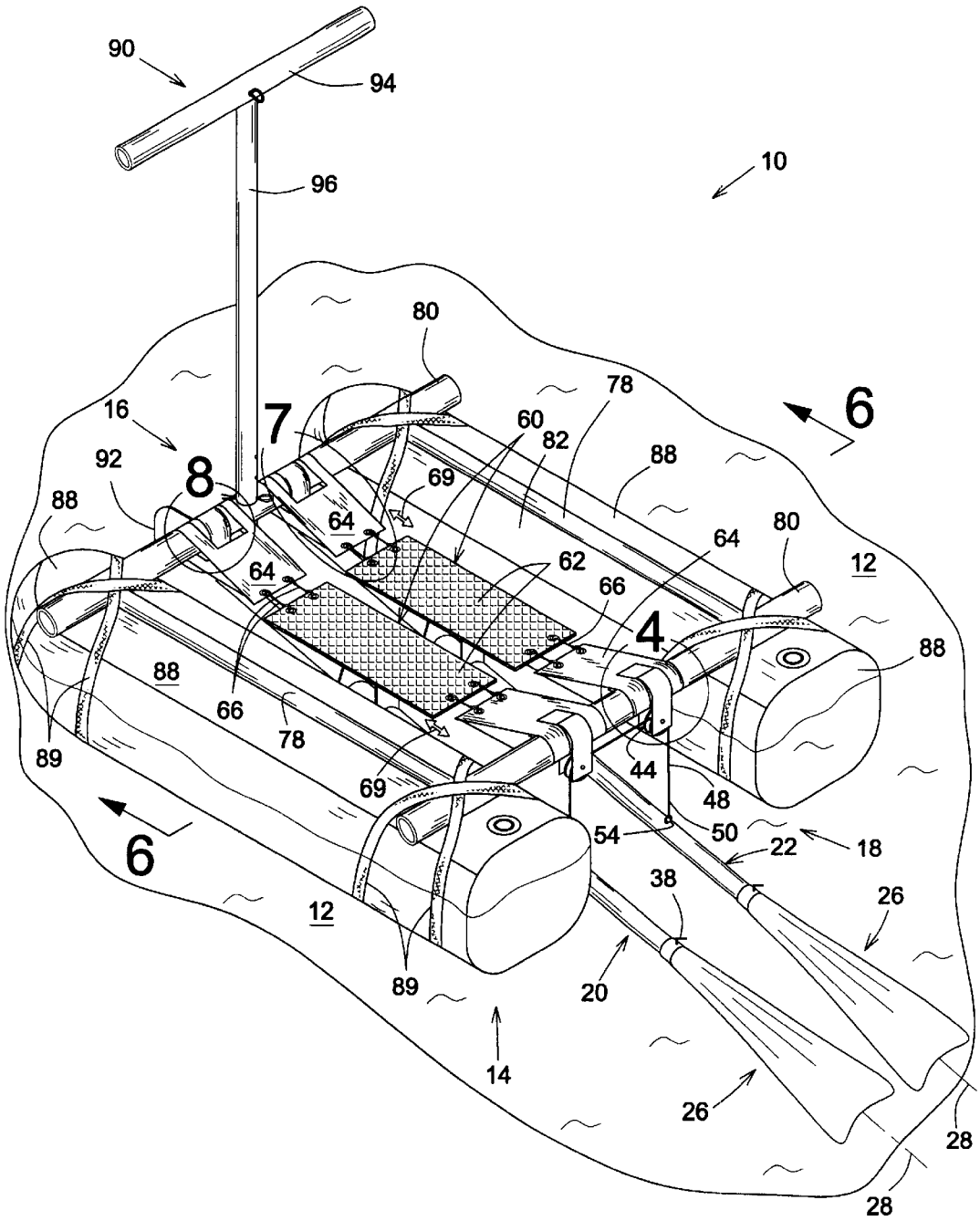
FIG. 1: in a perspective view, illustrates a feet-propelled water vehicle in accordance with an embodiment of the present invention, the vehicle being shown floating on the surface of a body of water.

With reference to FIG. 1, there is shown a feet-propelled water vehicle 10 in accordance with an embodiment of the present invention. The vehicle 10 is shown floating on the surface of a body of water 12. The vehicle 10 is intended to allow a user (not shown) to travel across the surface of the body of water 12. The vehicle 10 being a feet-propelled vehicle, the propulsion thereof is effectuated by having a user force emanating from the intended user transmitted to the vehicle by the feet of the intended user.

The vehicle 10 includes a buoyant body 14 having buoyancy characteristics enabling the device 10 to support an intended load including an intended user. The body 14 defines a body first end 16 and a generally opposed body second end 18.

The vehicle 10 also includes at least one and preferably two paddles operatively coupled to the buoyant body 14 for movement relative thereto. Typically, the vehicle 10 includes a first propelling paddle 20 and a second propelling paddle 22, both operatively coupled to the buoyant body 14 for movement relative thereto, preferably adjacent the body first end 16. Alternatively, the foot-propelled water vehicle 10 could include a single propelling paddle or more than two propelling paddles without departing from the scope of the present invention.

Figure 2:
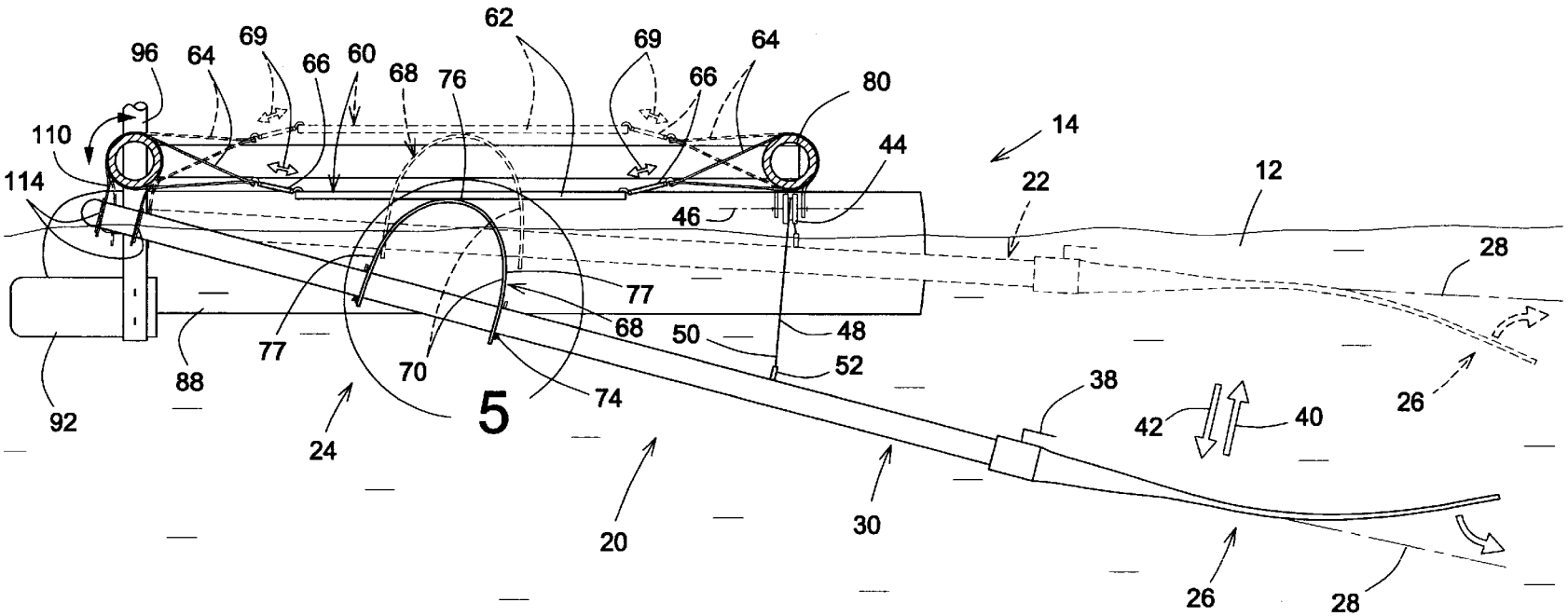
FIG. 2: in longitudinal cross-sectional view, illustrates some of the components of the embodiment of FIG. 1.

As illustrated more specifically in FIG. 2, the first and second propelling paddles 20, 22 each defines a corresponding effectuating section 24 and a corresponding blade section 26. Typically, the first and second propelling paddles 20, 22, shown in full and phantom lines respectively in FIG. 2, for clarity purposes, extend in a direction leading from the body first end 16 to the body second end 18 with the effectuating sections 24 being located more proximally to the vehicle first end 16 than the blade sections 26.

Each effectuating section 24 allows the transformation of the user force emanating from the intended user and transmitted to the effectuating section by the feet of the latter into a corresponding paddle movement of a corresponding paddle 20, or 22 relative to the buoyant body 14. In turn, each blade section 26 allows the transformation of a corresponding paddle movement into a vehicle propelling force for propelling the vehicle 10 across the body of water 12.

Each propelling paddle 20, 22 typically has a generally elongated and tubular configuration defining a corresponding paddle longitudinal axis 28. Optionally, each propelling paddle 20, 22 may be provided with a corresponding spacing section 30 located intermediate corresponding effectuating and blade sections 24, 26. Also, optionally, each spacing section 30 may be provided with a paddle length adjustment means (not shown) for allowing adjustment of the length of the corresponding propelling paddle 20, 22. Alternatively, although not illustrated, each of the first and second propelling paddles 20, 22 could have a non-circular cross-section in order to prevent rotation about its own axis 28 relative to the buoyant body 14 and its components.

In one embodiment of the invention, the paddle length adjustment means could includes a pair of telescopic spacing segments (not shown) extending about the spacing section 30 and telescopically coupled relative to each other. The spacing segments are typically provided with spacing segment releasable locking means (not shown) for releasably locking the spacing segments in a predetermined telescopic relationship relative to each other. The spacing segment releasable locking means may take any suitable form such as a conventional locking pin and locking aperture arrangement.

The paddle length adjustment means would allow for a reduction in the required transportation and storage space since it allows for the propelling paddles 20, 22 to be shortened for transportation and storage.

Also, the paddle length adjustment means would allow for customization of the length of the propelling paddles 20, 22 depending on physical characteristics such as density and viscosity of the body of water 12, strength and balance of the intended user, size of the buoyant body 14 and so forth.

Optionally, each blade section 26 may be provided with a blade section releasable attachment means for releasably attaching the blade section 26 to a corresponding effectuating section 24 or to a corresponding spacing section 30 when the latter is provided. The blade section releasable attachment means may take any suitable form such as a conventional releasable locking pin and locking aperture arrangement 38. The blade section releasable attachment means allows detachment of the blade section 26 in order to reduce transportation and storage space. The blade section releasable attachment means also allows an intended user to use different types of blade sections 26 depending on physical characteristics such as the density and viscosity of the body of water 12, the strength and experience of the intended user, the type of activity (leisure or competitive) and so forth.

Each blade section 26 typically has a generally flat and frustro-triangular configuration. It should however be understood that the blade sections 26 could have other geometrical configurations without departing from the scope of the present invention. Also, the blade sections 26 are typically made out of a generally flexible material such as a suitable polymeric or elastomeric resin. Typically, although by no means exclusively, the blade sections 26 may be given a general configuration and the general physical characteristics of scuba diving fins or the like. It should however be understood that the blade sections 26 could be made of a rigid material and be given other characteristics without departing from the scope of the present invention as long as they allow for transformation of the paddle movement into a vehicle propelling force for propelling the vehicle 10 across the body of water 12.

Optionally, in situations wherein the blade section 26 is given a generally frustro-triangular configuration, the blade sections 26 may be provided with a width adjustment means (not shown) for adjusting the width of the blade sections 26. The width adjustment means may take any suitable form such as an accordion-type means of adjusting the width of the blade sections 26.

The first and second propelling paddles 20, 22 are operatively coupled to the buoyant body 14 so as to be able to move in a first paddle direction generally towards the buoyant body 14 and in a second paddle direction generally away from the buoyant body 14. The first and second propelling paddles 20, 22 are typically operatively coupled to the buoyant body 14 for pivotal movement relative thereto as indicated throughout the figures. However, it should be understood that the propelling paddles 20, 22 could be operatively coupled to the buoyant body 14 for other types of movements relative thereto such as translational movement, a combination of translational movement and rotation or any other movement pattern without departing from the scope of the present invention.

In FIG. 2, the first paddle direction oriented generally towards the buoyant body 14 is indicated by arrow 40 while the second paddle direction oriented generally away from the buoyant body 14 is indicated by arrow 42.

The vehicle 10 typically further includes an alternating means for ensuring that the first and second propelling paddles 20, 22 move alternatively relative to each other in opposite paddle direction. The alternating means typically further ensures that at least a portion of the user force exerted on one of the first or second propelling paddles 20, 22 for moving the latter in a given paddle direction is transmitted to the other propelling paddle 20, 22 for moving the latter in the other paddle direction.

As shown more specifically in FIGS. 1, 2, 3 and 4, the alternating means typically includes at least one, and preferably two, alternating pulleys 44 rotatably attached to the buoyant body 14 for rotation about a pulley axis 46. The alternating means also includes a generally elongated and flexible alternating transmission component 48. The alternating transmission component 48 defines a pair of longitudinally opposed transmission component ends 50. Each of the transmission component ends. 50 is attached to one of the propelling paddles 20, 22 by a transmission component-to-propelling paddle attachment means. The transmission component 48 is at least partially wound around the alternating pulleys 44 for guided movement relative thereto.

Typically, the transmission component 48 takes the form of a cable pulley, a cable strap or any other suitable means. Also, typically, the transmission component-to-propelling paddle attachment means typically includes a cable attachment pin 52 protruding from the propelling paddles 20, 22 in a direction generally perpendicular to the propelling paddle longitudinal axis 28. The cable attachment pins 52 are provided with a cable attachment aperture 54 extending therethrough for allowing attachment of the transmission component ends 50.

Alternatively, the transmission component-to-propelling paddle attachment means may be provided with a quick-disconnect type of connection allowing for the cable 48 to be easily and readily detached from the buoyant body 14 and from the propelling paddles 20, 22 in order to facilitate transportation and storage of the vehicle 10.

Also, optionally, the transmission component-to-propelling paddle attachment means may be provided with an attachment positioning means (not shown) for allowing the transmission component-to-propelling paddle attachment means to be moved relative to the propelling paddles 20, 22 along their longitudinal axis 28. Movement of the transmission component-to-propelling paddle attachment means would allow for customization of the positioning of the transmission component-to-propelling paddle attachment means in situations wherein the length of the propelling paddles 20, 22 and/or the buoyant body 14 would be adjustable. It would also allow for customization of the positioning of the transmission component-to-propelling paddle attachment means depending on user preferences and physical parameters such as density and viscosity of the body of liquid 12.

Figure 3:
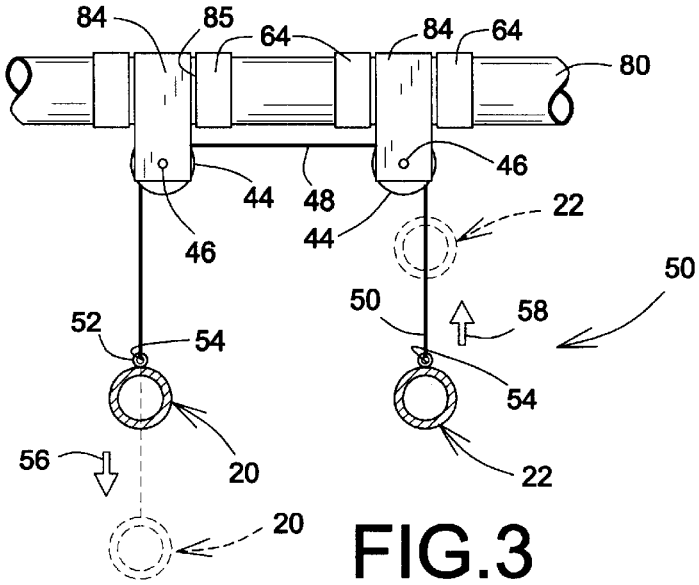
FIG. 3: in a partial rear elevation view with sections taken out, illustrates the reciprocating movement between a pair of propelling paddles both part of the embodiment of FIG. 1.

As shown more specifically in FIG. 3, the alternating pulleys 44 provide guidance for the movement of the transmission component 48 as the latter ensures that the first and second propelling paddles 20, 22 pivot alternatively relative to each other in opposite paddle directions. For example, as the propelling paddle 20 on the left-hand-side of FIG. 3 moves downwardly as indicated by arrow 56 to a position illustrated in phantom lines, the propelling paddle 22 on the right-hand-side of FIG. 3 moves upwardly as indicated by arrow 58 to a position also illustrated in phantom lines.

As shown more specifically in FIGS. 1 and 4 through 7, the buoyant body 14 typically includes a user-supporting platform 60 having generally flexible characteristics and defining a force transmitting section also referred to as a foot contacting region or plate 62. The user-supporting platform 60 is designed so as to be able to deform under the action of the user force so as to transmit the user force to the propelling paddles 20, 22. In an embodiment of the invention (not shown) only the force transmitting section or foot contacting plate 62 includes flexible material while the remainder of the user-supporting platform 60 is made out of a rigid material.

In the embodiment shown in FIGS. 1 and 4 through 7, the user-supporting platform 60 is made out of the foot contacting plate 62 attached to plate retaining members 64 via generally flexible components 66, such as rubber bands or the like. The plate retaining members 64 are attached to a generally rigid peripheral frame. The user-supporting platform 60 is hence able to deform under the action of the user force so as to transmit the user force to the propelling paddles 20, 22.

Typically, the vehicle 10 further includes a force transmitting component 68 positioned intermediate each propelling paddle 20, 22 and the corresponding foot contacting plate 62 of the user-supporting platform 60. As illustrated more specifically in FIGS. 2, 5 and 6, each force transmitting component 68 includes a generally semi-rigid resilient elongated plate 70. Each semi-rigid plate 70 defines two opposed openings 72 at opposed longitudinal ends thereof, the latter forming a spacing section 77 of the force transmitting component 68. Each opening 72 substantially slidably engages the effectuating section 24 of the propelling paddle 20, 22 and is secured thereto via a force transmitting component-to-propelling paddle attachment means. The latter is preferably in the form of attachment pins 74 releasably engaging corresponding through holes 75, generally perpendicularly oriented relative to the paddle longitudinal axis 28, of the effectuating section 24 of the propelling paddle 20, 22.

Each semi-rigid plate 70 forms a substantially semi-elliptical component which includes the spacing section 77 attached to the paddle effectuating section 24 and also a corresponding substantially central apex region also referred to as a plate contacting section 76 attached to the spacing section 77. The plate contacting section 76 is configured, sized and positioned so as to be able to, preferably slidably, contact the user-supporting platform 60 adjacent the foot contacting plate 62. The force transmitting components 68 thus maintain at least a section of the user-supporting platform 60 and the propelling paddles 20,22 in a spaced relationship relative to each other while allowing the transmission of the user force from the user-supporting platform 60 to the propelling paddles 20, 22. The force transmitting components 68 allow the propelling paddles 20, 22 to remain under the surface of the body of water 12 in an angled relationship relative to the user-supporting platform 60 when the latter extends over the top surface of the body of water 12 in a generally parallel and proximate relationship relative thereto.

Figure 6:
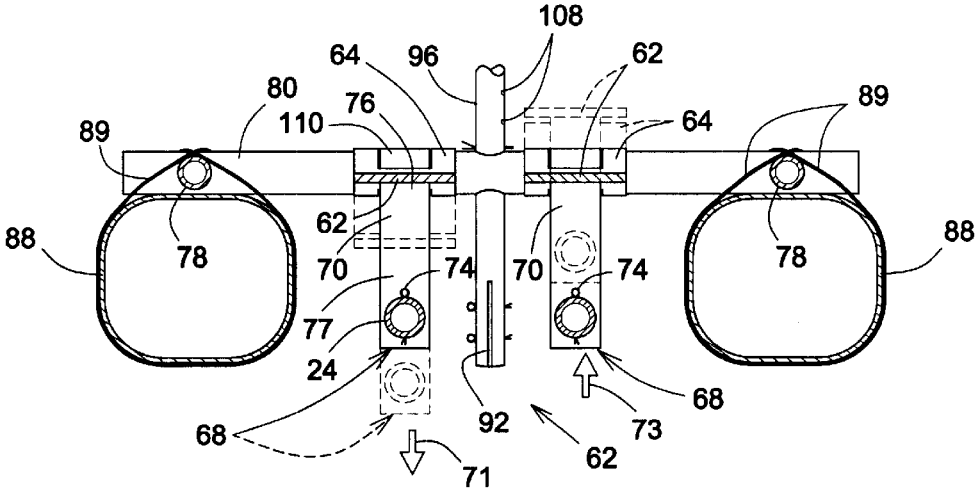
FIG. 6: a partial transversal cross-sectional view taken along line 6—6 of FIG. 1 with sections taken out, illustrates some of the components associated with a user-supporting platform of the embodiment of FIG. 1.

FIG. 6 illustrates the relationship between the propelling paddles 20, 22, the corresponding force transmitting components 68 and the foot contacting plates 62 of the user-supporting platform 60 as the foot contacting plate 62 is displaced allowing the propelling paddle 20, shown on the left-hand-side of FIG. 6, to be lowered in a direction indicated by arrow 71 from a position illustrated in full lines to a position shown in phantom lines and for the propelling paddle 22, shown on the right-hand-side of FIG. 6, to be raised, as indicated by arrow 73, from a position shown in full lines to a position shown in phantom lines.

Also, preferably, each semi-rigid plate 70 is provided with a corresponding semi-elliptical shape adjusting means for allowing adjustment of the semi-elliptical shape of the semi-rigid plate 70. The semi-elliptical shape adjusting means allows for customization of the distance between the foot contacting section 76 and the corresponding propelling paddles 20, 22 so as to allow for spacing and angular adjustment between the foot contacting section 76 with its corresponding foot contacting plate 62 and the corresponding propelling paddles 20, 22 to which they are attached. The semi-elliptical shape adjusting means is preferably provided by a plurality of through holes 75 spaced apart, preferably equally, along the effectuating section 24 of the propelling paddle 20, 22. Customization of the spacing and angular relationship between the foot contacting section 76 and the corresponding propelling paddles 20, 22 may be adjusted depending on ergonomic factors relating to the morphology and strength of the intended user as well as physical characteristics such as density and viscosity of the body of water 12 in which the vehicle 10 is being used.

As mentioned previously, the buoyant body 14 typically includes a generally rigid peripheral frame. The peripheral frame, in turn, typically includes a set of frame tubular members assembled together. In the embodiment shown throughout the figures, the buoyant body 14 has a generally rectangular configuration, the longer axis of the rectangle extending between the body first end 16 and the body second end 18.

Accordingly, in the embodiment shown throughout the figures, the peripheral frame includes a pair of longitudinal tubular members 78 extending between the body first and second ends 16, 18 in a generally parallel and spaced relationship relative to each other. Also, the peripheral frame includes a pair of transversal tubular members 80 extending in a generally parallel and spaced relationship relative to each other. The longitudinal and transversal tubular members 78, 80 are typically assembled together adjacent longitudinal ends thereof so as to form a generally rectangular peripheral frame for mounting the user-supporting platform 60 thereto.

Typically, the user-supporting platform 60 is attached at opposed longitudinal ends thereof to the transversal tubular members 80. Each retaining member 64 of the user-supporting platform 60 is preferably a semi-rigid elongated sheet folded around a corresponding transversal tubular member 80 with its opposed longitudinal ends held adjacent to each other by the flexible component 66. Hence, during displacement of the foot contacting plate 62, the retaining member 64 is allowed to slightly pivot about the axis of the corresponding transversal tubular member 80.

Figure 7:
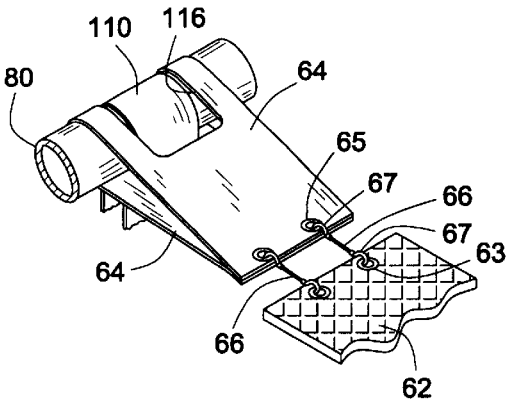
FIG. 7: in a partially broken close-up detailed perspective view taken along line 7 of FIG. 1, illustrates some of the components for connecting a foot contacting plate to a frame component, the foot contacting plate and the frame component being art of the embodiment of FIG. 1.

Each foot contacting plate 62 is held in place in between the two transversal tubular members 80 by corresponding retaining members 64 via corresponding rubber bands 66. More specifically, as shown in FIG. 7, the opposed longitudinal ends of each generally elongated rubber band 66 are provided with releasable hooks 67 for engagement with corresponding eyelets 63, 65 of the foot contacting plate 62 and the retaining member 64, respectively. When the user-supporting platform 60 is assembled together, the rubber bands 66 are in stretched configuration, as illustrated by arrows 69 in FIGS. 1 and 2.

Typically, also, the user-supporting platform 60 is spaced along longitudinal edges thereof relative to the longitudinal tubular members 78 so as to create a platform-to-frame longitudinal spacing 82 between both longitudinal edges of the user-supporting platform 60 and the adjacent longitudinal tubular members 78. The platform-to-frame longitudinal spacing 82 is intended to facilitate flexion of the user-supporting platform 60 relative to the peripheral frame.

Optionally, the longitudinal and transversal tubular members 78, 80 may be assembled together using a releasable type of connecting means for releasably connecting the tubular members 78, 80 together while allowing quick and easy disassembly of the peripheral frame. The tubular member connecting means may take any suitable form such as conventional locking pin and locking aperture type of connection. The releasable type of tubular member connecting means is intended to facilitate assembly and disassembly of the peripheral frame so as to facilitate storage and transportation of the vehicle 10.

Accordingly, the rubber bands 66 are preferably simultaneously used as tensioning members to maintain the peripheral frame together with the longitudinal tubular members 78 axially compressed between the two transversal tubular members 80, as shown in FIG. 2.

Also, optionally, the longitudinal and/or transversal tubular members 78, 80 may be provided with tubular member length adjustment means (not shown) for allowing adjustment of the length of the longitudinal and/or transversal tubular members 78, 80. The tubular member length adjustment means may take any suitable form such as a telescopic type of length adjustment means having releasable locking means for releasably locking the tubular members 78 and/or 80 in a predetermined telescopic configuration for allowing adjustment of the size of the peripheral frame.

Similarly, the user-supporting platform 60 may be provided with a supporting platform size adjustment means (not shown) for allowing adjustment of the size of the user-supporting platform 60. In one embodiment of the invention, the user-supporting platform 60 may include a sheet 118 or membrane of relatively flexible material (see FIG. 11). The sheet 118 of relatively flexible material could be attached to one of the transversal tubular members 80 by a roll-up type of attachment mechanism (not shown) allowing selective deployment of the sheet 118 of substantially flexible material across the peripheral frame and adjustment of the size of the sheet 118 depending on the size of the frame. Adjustment of the size of the peripheral frame and of the user-supporting platform 60 would allow for customization of the size of the buoyant body 14. The size of the buoyant body 14 would be adjusted depending on the size of the user, the need for carrying a passenger and/or cargo and other preferences and parameters.

Typically, the alternating pulleys 44 are rotatably attached to the buoyant body 14 by corresponding pulley attachment tongues 84 extending generally perpendicularly from one of the transversal tubular members 80 by folding there around similarly to the retaining means 64 of the user-supporting platform 60. Each pulley attachment tongue 84 is provided with a pulley axle receiving aperture for rotatably receiving a pulley axle rotating about the pulley axis 46 of the alternating pulleys 44.

Figure 4:
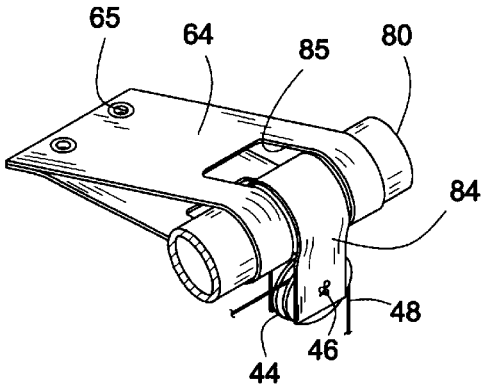
FIG. 4: in an enlarged perspective view taken along line 4 of FIG. 1 with sections taken out, illustrates some details of the components used for attaching the alternating pulley mechanism.
Figure 5:
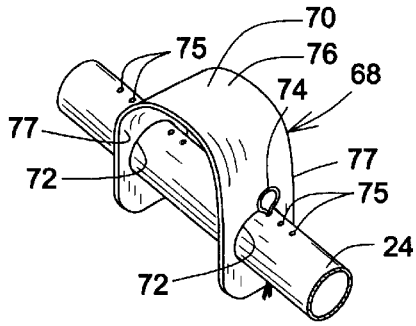
FIG. 5: in an enlarged broken perspective view taken along line 5 of FIG. 2, illustrates some details of the components used of the effectuating section of each propelling paddle.

In order for each pulley axle to be positioned substantially parallel to and generally vertically above the corresponding paddle longitudinally axis 28, the pulley attachment tongue 84 is located within a generally transversely centrally located opening 85 defined by the corresponding retaining means 64, as shown in FIGS. 1, 3 and 4.

The vehicle 10 could also typically include a range of movement limiting means (not shown) mechanically coupled to the first and second propelling blades 20, 22 for limiting the range of movement of the first and second propelling blades 20, 22 in the first and second paddle directions. In one embodiment, the range of movement limiting means would include a range of movement limiting components (not shown) attached to the alternating cable 48 adjacent the propelling paddles 20, 22. The range of movement limiting components are configured, sized and positioned so as to abuttingly contact the corresponding adjacent pulley attachment tongues 84 for limiting the range of movement of the alternating cable 48 and, hence, of the propelling paddles 20, 22. Optionally, the range of movement limiting components may be provided with range of movement component positioning means (not shown) for allowing displacement of the range of movement limiting components along the alternating component 48 so as to allow for customization of the range of movement of the propelling paddles 20, 22 depending of preferences and physical parameters.

Typically, the vehicle 10 further includes at least one, and preferably two, pontoon-type components 88. The pontoon-type components 88 are typically attached to the peripheral frame by releasable frame-to-pontoon attachment means. The releasable frame-to-pontoon attachment means, preferably elastic straps 89 or the like, allows the pontoon-type components 88 to be easily attached and detached to and from the peripheral frame through a set of quick and ergonomic steps. The releasable attachment between the peripheral frame and the pontoon-type components 88 again facilitates transportation and storage of the vehicle 10. Optionally, the pontoon-type components 88 are inflatable pontoons so as to further reduce the required storage and transportation space.

Typically, the pontoon-type components 88 are attached to the longitudinal ends of the transversal tubular members 80 so as to extend in a generally parallel and proximal relationship relative to the longitudinal tubular members 78, preferably underneath thereof so as to support the peripheral frame above the top surface of the body of water 12. Also, optionally, the releasable frame-to-pontoon attachment means allows for attachment of the transversal tubular members 80 at various positions along the length of the pontoon-type components 88 so as to allow for variation of the size of the peripheral frame and of the user-supporting platform 60. Typically pontoon-type components 88 define a generally hydrodynamic convex configuration adjacent the body first longitudinal end 16.

The vehicle 10 preferably includes a steering structure 90 attached to the buoyant body 14. The steering structure 90, in turn, typically includes a rudder 92 attached to a steering handle 94 by a steering rod 96.

Figure 9:
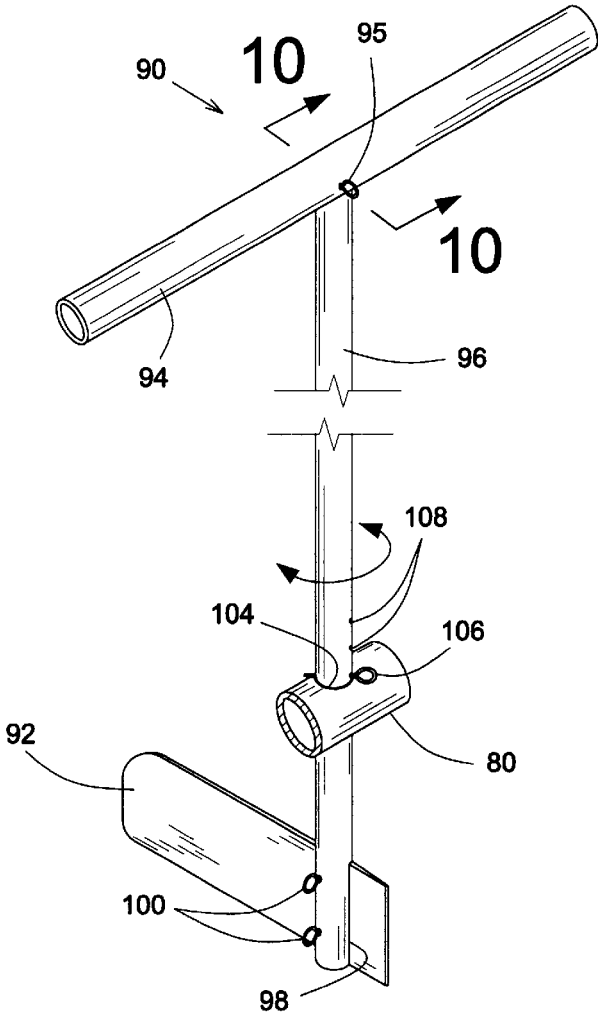
FIG. 9: in an enlarged broken perspective view with sections taken out, illustrates some of the components associated with a steering mechanism part of the embodiment of FIG. 1.

As shown more specifically in FIG. 9, the rudder 92 is typically attached to the steering rod 96 by a rudder-to-rod releasable attachment means allowing for quick and easy attachment and detachment of the rudder 92 to and from the steering rod 96. Typically, the rudder-to-rod releasable attachment means includes a longitudinal rudder slot 98 located at a distal end of the steering rod 96 and configured and sized for insertion of the rudder 92 therethrough. Rudder pins 100 extend through corresponding pin through holes formed in the rudder slot 98 and steering rod 96 perpendicularly to the plane defined by the rudder slot 98 for releasably locking the rudder 92 in the rudder sleeve 98 of the distal end of the steering rod 96.

The steering rod 96 extends in a radially oriented through hole 104 of the transversal tubular member 80 positioned adjacent the body first end 16. The steering rod 96 is slidably mounted within the radial through hole 104 so as to prevent relative movement therebetween about their longitudinal axis while allowing relative rotation therebetween about their respective longitudinal axis.

Typically, the radial through hole 104 extends through the transversal tubular member 80 in a direction generally perpendicular to the geometrical plane formed by the tubular members 78, 80. Optionally, a pair of reinforcement rods (not shown) could extend at an angle between the transversal tubular member 80 and the steering rod 96 so as to stabilize the latter. Typically, the steering rod 96 extends through the radial through hole 104 of the transversal tubular member 80 to a position underneath the buoyant body 14 for allowing the rudder 92 to be positioned under the surface of the body of water 12 when the buoyant body 14 floats on the latter.

The steering rod is prevented from axial movement in the direction of the body of water via a steering rod-to-transversal tubular member securing means, preferably a simple steering rod pin 106 engaging a corresponding oriented through hole 108 extending radially therethrough. Optionally, the distance between the handle 94 and the peripheral frame, or the height of the handle 94, is adjusted via a steering rod-to-transversal tubular member adjusting means allowing for an intended user to customize the height of the handle 94 depending on preferences and ergonomic characteristics. Preferably, the steering rod-to-transversal tubular member adjusting means includes a plurality of through holes 108 spaced apart, preferably equally, along the steering rod 96.

Figure 10:
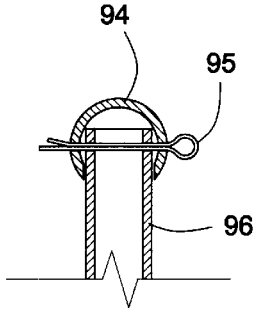
FIG. 10: in an enlarged section view taken along line 10—10 of FIG. 9, illustrates some details of the components used for attaching the handle component to the steering member of the embodiment of FIG. 1.

As shown more specifically, in FIG. 10, the handle 94 is preferably releasably attached to the proximal end of the steering rod 96 via a handle connecting means. The latter may take any suitable means such as conventional locking pin and locking aperture type of connection 95. The releasable type of handle connecting means is intended to facilitate assembly and disassembly of the steering structure 90 so as to facilitate storage and transportation of the vehicle 10.

Figure 8:
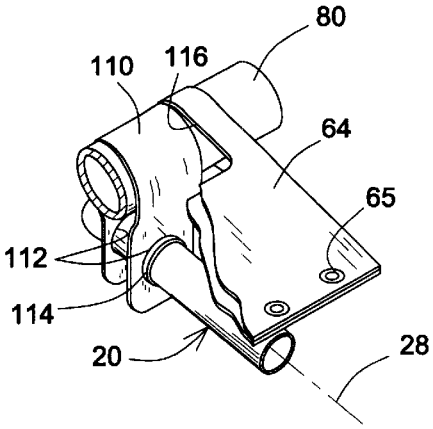
FIG. 8: in a partial close-up detailed perspective view taken along line 8 of FIG. 1, illustrates some of the components for connecting a propelling paddle to a frame component, the propelling paddle and the frame component being part of the embodiment of FIG. 1.

As illustrated more specifically in FIGS. 2 and 8, the first and second propelling paddles 20, 22 are preferably releasably attached to the buoyant body 14 by a paddle-to-body releasable attachment means. Each paddle-to-body releasable attachment means typically includes a paddle-receiving sheet 110 typically having a generally flat configuration and folded around the transversal tubular member 80 adjacent the body first end 16, similarly to the pulley attachment tongue 84, for defining a corresponding paddle-receiving opening 112 at each opposite longitudinal end thereof. The paddle-receiving opening 112 is configured and sized for substantially fittingly receiving a proximal end of the first or second propelling paddles 20, 22 located adjacent the paddle effectuating section 24. By folding around the transversal tubular member 80 each paddle-receiving sheet 110 is pivotally attached thereto. A paddle-to-paddle-receiving sheet attaching means allowing for quick and easy attachment and detachment of the paddle 20, 22 to and from the paddle-receiving sheet 110. Typically, the paddle-to-paddle-receiving sheet attaching means are circumferentially and radially stretchable sleeves 114 preventing slidable movement of the paddle-receiving sheet 110 relative to the corresponding propelling paddle 20, 22 along the paddle longitudinal axis 28.

Similarly to the pulley attachment tongues 84, in order for the user-supporting platform 60 and more specifically for each foot contacting plate 62 to be longitudinally oriented substantially in a parallel relationship relative to the corresponding paddle longitudinal axis 28, the paddle-receiving sheet 110 is positioned within a generally transversely centrally located opening 116 defined by the corresponding retaining means 64, as shown in FIGS. 1 and 7.

Also, the steering handle 94 could be provided with a pair of handle bars (not shown) for facilitating grasping of the handle 94 for both steering and user stabilization purposes.

Typically, the longitudinal and transversal tubular members 78, 80 as well as the steering rod 96, the handle 94 and the propelling paddles 20, 22 (except for the blade sections 26) are made out of a suitable rigid yet light-weight material such as a suitable polymeric resin or aluminum alloy. Typically, the pontoons 88 are made of a suitable inflatable material such as a suitable polymeric resin or the like. Typically, the foot contacting plate 62 of the user-supporting platform 60 as well as the rudder 92 are made out of a generally rigid suitable polymeric type material or the like. The retaining means 64 as well as the force transmitting components 68, the pulley attachment tongues 84 and the paddle-receiving sheets 110 are preferably made out of a sheet of suitable flexible semi-rigid material such as a sheet of elastomeric or polymeric resin material. Optionally, the sheets, plates and tubular members of elastomeric or polymeric resin material are made out of a transparent material in order to give intended user and/or bystanders the impression that the intended user is "walking on water". Also, optionally, the user-supporting platform 60 may include a section thereof formed of a material that changes color or tint depending on the temperature of the body of water 12 so as to provide an indication to the intended user of the temperature of the body of water 12.

Figure 11:
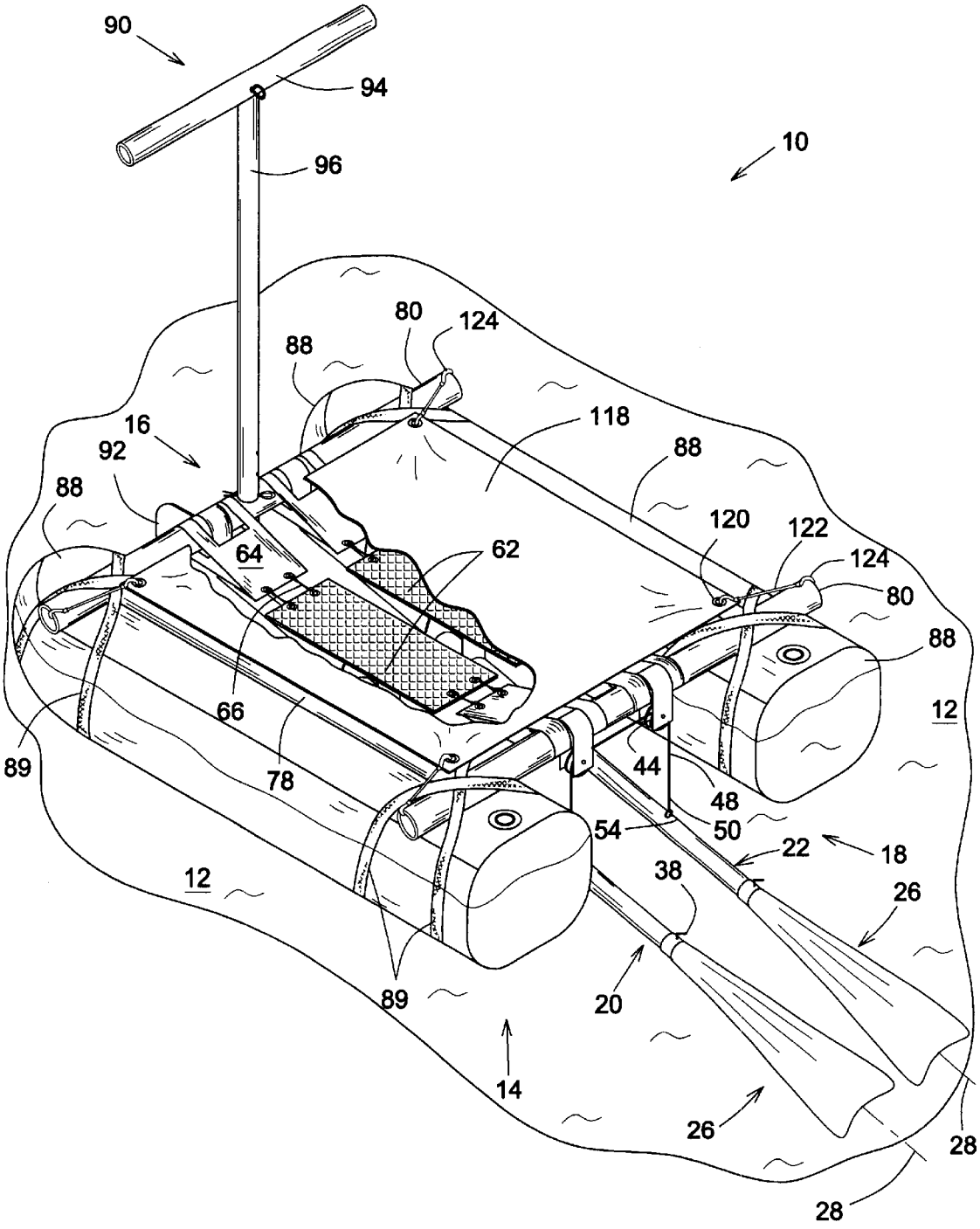
FIG. 11 in a perspective view similar to FIG. 1, illustrates some details of the components used for attaching a flexible membrane to the frame component, the flexible membrane and the frame component being part of a feet-propelled water vehicle in accordance with an embodiment of the present invention.

As illustrated more specifically in FIG. 11, the vehicle 10 may optionally include a flexible membrane 118 covering the user-supporting platform 60 to prevent water from splashing onto the feet or legs of the intended user and substantially keep the top surface of the buoyant body 14 dry. Typically, the flexible membrane 118, preferably made out of any suitable flexible and stretchable material, is secured to the longitudinal ends of the transversal tubular members 80. The latter being engaged by hooks 124 or the like connected to an eyelet 120 of a corresponding corner of the flexible membrane, preferably via elastic bands 122. The flexible membrane 118 preferably covers the overall region defined by the peripheral frame while keeping the platform-to-frame longitudinal spacing 82 as small as possible, if any.

The vehicle 10 may be easily steered either through the use of the steering rudder 92 or by selectively using only one of the propelling paddles 20, 22 while having the reciprocating or alternating mechanism deactivated.

In use, the intended user merely needs to step on the user-supporting platform 60, preferably adjacent the feet contacting regions 62. Once balanced on the user-supporting platform 60, the intended user merely needs to effectuate a simple weight shifting action to shift the user's weight from one foot to the other, or a stepping motion similar to that of conventional step related exercise equipment. The user force generated by the weight shifting action is transferred to the effectuating section 24 of the propelling paddles 20, 22 by the force transmitting component 68. Pivotal movement of the propelling paddles 20, 22 is transmitted to the blade sections 26. In turn, the stroke of the blade sections 26 converts the user force into a propelling force for propelling the vehicle 10 across the surface of the body of water 12.

When not in use, during transportation or storage, the vehicle 10 may be totally disassembled by removing the propelling paddles 20, 22 from the frame member. Removing the pontoons 88 from the peripheral frame, separating the tubular components 78, 80 of the peripheral frame, removing the steering components 90 and shortening all the components having length adjustment means to the smallest length. The components may be rolled into a pile surrounded by the flexible membrane 118 whenever applicable. The vehicle 10 may hence be easily transported from one location to another and stored in a backpack type of bag or any suitable envelope.

Although the present feet-propelled water vehicle has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. A feet-propelled water vehicle for allowing an intended user having a pair of feet to travel across the surface of a body of water, each of said feet being able to transmit a user force emanating from said user, said vehicle comprising:

a buoyant body, said body defining a body first end and a generally opposed body second end;

a first propelling paddle and a second propelling paddle both operatively coupled to said buoyant body for movement relative thereto;

each of said first and second propelling paddles defining a corresponding effectuating section and a corresponding blade section, said effectuating sections allowing the transformation of said user force into a paddle movement of said propelling paddles relative to said buoyant body, said blade sections allowing the transformation of said paddle movement into a vehicle propelling force for propelling said vehicle when said blade sections are in contact with said body of water; said buoyant body including a generally rigid peripheral frame and a generally flexible user-supporting platform attached to said peripheral frame, said user-supporting platform being able to deform under the action of said user force so as to transmit said user force to said first propelling paddles; said user-supporting platform defining a foot contacting region for contacting at least one of said feet and wherein said vehicle further comprises a force transmitting component positioned intermediate each of said first and second propelling paddles and said user-supporting platform, each of said force transmitting components including a spacing section attached to said first or second propelling paddles and a foot contacting section attached to said spacing section, said foot contacting sections being configured, sized and positioned so as to be able to contact said user-supporting platform adjacent said foot contacting region, said force transmitting component maintaining at least a section of said user-supporting platform and said first and second propelling paddles in a spaced relationship relative to each other while allowing the transmission of said user force from said user-supporting platform to said first propelling paddle; said force transmitting component being an elongated plate, said elongated plate having a substantially semi-elliptical shape defining two opposed longitudinal ends thereof and a central apex region therebetween, said two longitudinal ends forming said spacing section and said apex region forming said foot contacting section, said force transmitting component being provided with a semi-elliptical shape adjusting means for allowing adjustment of the semi-elliptical shape of said elongated plate so as to adjust said spaced relationship between said first and second propelling paddles and said user-supporting platform.

2. A vehicle as recited in claim 1, wherein:

said first and second propelling paddles are operatively coupled to said buoyant body for pivotal movement relative thereto, each of said first and second propelling paddles being operatively coupled to said buoyant body so as to be able to pivot in a first paddle direction generally towards said buoyant body and in a second paddle direction generally away from said buoyant body;

said vehicle further comprising an alternating means for ensuring that said first and second propelling paddles pivot alternatively relative to each other in opposite paddle directions, said alternating means further ensuring that at least a portion of the user force exerted on one of said first or second propelling paddles for pivoting the latter in a given paddle direction is transmitted to the other propelling paddle for pivoting the latter in the other paddle direction.

3. A vehicle as recited in claim 2, wherein said alternating means includes an alternating pulley rotatably attached to said buoyant body for rotation about a pulley axis, said alternating means also including a generally elongated and flexible alternating transmission component, said alternating transmission component defining a pair of longitudinally opposed transmission component ends, each of said transmission component ends being attached to one of said propelling paddle; said transmission component being at least partially wound around said alternating pulley for guided movement relative thereto; whereby said alternating pulley rotatably guides the movement of said transmission component as the later ensures that said first and second propelling paddles pivot alternatively relative to each other in opposite paddle directions.

4. A vehicle as recited in claim 1, wherein said buoyant body includes a flexible membrane securing to said peripheral frame, said flexible membrane covering at least said user-supporting platform so as to prevent water from splashing thereon.

5. A vehicle as recited in claim 1, wherein said peripheral frame includes tubular members assembled together, and said user-supporting platform including a sheet of flexible material attached to said tubular members for protecting the user from being watered by splashing water.

6. A vehicle as recited in claim 1, wherein said peripheral frame includes tubular members assembled together, and said user-supporting platform includes a sheet of flexible material attached to said tubular members for protecting said user from being watered by splashing water, said vehicle further comprising at least one pontoon attached to said peripheral frame.

7. A vehicle as recited in claim 6, wherein said pontoon is an inflatable pontoon.

8. A vehicle as recited in claim 1, further comprising a steering structure attached to said buoyant body, said steering structure including a rudder and a steering handle attached to said rudder.

9. A vehicle as recited in claim 8, wherein said steering structure is releasably attached to said buoyant body.

10. A vehicle as recited in claim 1, wherein each one of said propelling paddles is releasably attached to said buoyant body.

11. A vehicle as recited in claim 1, wherein each one of said blade sections is releasably attached to said respective effectuating section.

12. A feet-propelled water vehicle for allowing an intended user having a pair of feet to travel across the surface of a body of water, each of said feet being able to transmit a user force emanating from said user, said vehicle comprising:

a buoyant body, said body defining a body first end and a generally opposed body second end;

a first propelling paddle and a second propelling paddle, said first and second propelling paddles being both operatively coupled to said buoyant body for pivotal movement relative thereto;

said first and second propelling paddles each defining a corresponding effectuating section and a corresponding blade section, each of said effectuating sections allowing the transformation of said user force into a corresponding paddle movement relative to said buoyant body, each of said blade sections allowing the transformation of a corresponding paddle movement into a vehicle propelling force for propelling said vehicle across said body of water;

each of said first and second propelling paddles being operatively coupled to said buoyant body so as to be able to pivot in a first paddle direction generally towards said buoyant body and in a second paddle direction generally away from said buoyant body;

said vehicle further comprising an alternating means for ensuring that said first and second propelling paddles pivot alternatively relative to each other in opposite paddle directions, said alternating means further ensuring that at least a portion of the user force exerted on one of said first or second propelling paddles for pivoting the latter in a given paddle direction is transmitted to the other propelling paddle for pivoting the latter in the other paddle direction;

said buoyant body including a generally rigid peripheral frame and a generally flexible user-supporting platform attached to said peripheral frame, said user-supporting platform being able to deform under the action of said user force so as to transmit said user force to said first and second propelling paddles;

said peripheral frame including tubular members assembled together, and said supporting platform including a sheet of flexible material attached to said tubular members, said vehicle further including at least one pontoon attached to said peripheral frame; said vehicle further including a steering structure attached to said buoyant body, said steering structure including a rudder and a steering handle attached to said rudder.

13. A vehicle as recited in claim 12, wherein said vehicle is collapsible, said tubular members being releasably attached to each other, said propelling paddles being releasably attached to said buoyant body, said at least one pontoon being releasably attached to said peripheral frame and said steering structure being releasably attached to said buoyant body.

14. A feet-propelled water vehicle for allowing an intended user having a pair of feet to travel across the surface of a body of water, each of said feet being able to transmit a user force emanating from said user, said vehicle composing:

a buoyant body, said body defining a body first end and a generally opposed body second end;

a first propelling paddle and a second propelling paddle, each of said first and second propelling paddles being operatively coupled to said buoyant body so as to be able to pivot in a first paddle direction generally towards said buoyant body and in a second paddle direction generally away from said buoyant body;

said first and second propelling paddles each defining a corresponding effectuating section and a corresponding blade section, each of said effectuating sections allowing the transformation of said user force into a corresponding pivotal paddle movement relative to said buoyant body, each of said blade sections allowing the transformation of a corresponding pivotal paddle movement into a vehicle propelling force for propelling said vehicle across said body of water;

said buoyant body including a user-supporting platform for supporting at least a portion of the weight of said intended user, said user-supporting platform being distinct from said first and second propelling paddles, said user-supporting platform being located in a substantially overlying relationship relative to at least a portion of said effectuating sections, said user-supporting platform defining a force transmitting section, said force transmitting section being able to deform under the action of said user force so as to transmit said user force to said effectuating sections allowing the transformation of said user force into a corresponding pivotal paddle movement relative to said buoyant body.

15. A vehicle as recited in claim 14 wherein said vehicle further comprises a pair of force transmitting components each positioned intermediate a contact location of a corresponding effectuating section and said user-supporting platform, said force transmitting components maintaining at least a section of said user-supporting platform and said first and second propelling paddles in a spaced relationship relative to each other while allowing the transmission of said user force from said user-supporting platform to said first and second propelling paddles.

16. A vehicle as recited in claim 14 wherein said buoyant body is calibrated so as to allow said user-supporting platform to remain above said surface of said body of water while both said first and second propelling paddles remain submerged underneath said surface of said body of water at least from said contact locations to said blade sections during use of said vehicle on said body of water.

17. A feet-propelled water vehicle for allowing an intended user having a pair of feet to travel across the surface of a body of water, said intended user having a user weight, each of said feet being able to transmit a user force emanating from said user, said vehicle comprising:

a buoyant body, said buoyant body including a pair of lateral pontoons, said pontoons defining a spacing therebetween, said pontoons being calibrated for being able to float on top of said body of water while supporting said user weight;

a first propelling paddle and a second propelling paddle, each of said first and second propelling paddles being operatively coupled to said buoyant body so as to be able to pivot in a first paddle direction generally towards said buoyant body and in a second paddle direction generally away from said buoyant body;

said first and second propelling paddles each defining a corresponding effectuating section and a corresponding blade section, each of said effectuating sections allowing the transformation of said user force into a corresponding pivotal paddle movement relative to said buoyant body, each of said blade sections allowing the transformation of a corresponding pivotal paddle movement into a vehicle propelling force for propelling said vehicle across said body of water, said effectuating sections being configured and sized so as to allow transmission of said user force and also configured and sized so as to reduce the drag force created thereby during pivotal movement in first and second paddle directions;

a user-supporting platform attached to said pontoons so as to be located in a substantially overlying relationship relative to at least a portion of said effectuating sections, said user supporting platform being used for supporting said intended user and transmitting said user weight to said pontoons, said user-supporting platform defining a force transmitting section said force transmitting section being able to transmit said user force to said effectuating sections.

18. A vehicle as recited in claim 17 wherein said first and second propelling paddles are configured, sized and made out of a paddle material enabling the buoyancy of said first and second propelling paddles to be substantially less than the buoyancy of said pontoons; whereby said user weight is buoyantly supported on said body of water mainly by said pontoons.

19. A vehicle as recited in claim 17 wherein said buoyant body includes a flexible membrane securing to said pontoons, said flexible membrane covering at least said user-supporting platform so as to prevent water from splashing thereon.

20. A vehicle as recited in claim 19 wherein said flexible membrane entirely covers said spacing between said pontoons.

* * * * *